US005185892A

United States Patent [19]

Mitchell

[11] Patent Number: 5,185,892

[45] Date of Patent: Feb. 16, 1993

[54] TUB AND SHOWER SEAT

[76] Inventor: Randall R. Mitchell, 7407 S. 41st Ave., Bellevue, Nebr. 68147

[21] Appl. No.: 800,280

[22] Filed: Nov. 29, 1991

[51] Int. Cl.[5] ..... A47K 3/12

[52] U.S. Cl. ..... 4/578.1; 297/14

[58] Field of Search ..... 4/571.1-574.1, 4/578.1, 604, 611; 297/14; 248/240, 240.1, 240.2, 240.3, 240.4; 108/81

[56] References Cited

U.S. PATENT DOCUMENTS

| | | | |
|---|---|---|---|
| 424,730 | 4/1890 | Schoonmaker | 4/578.1 X |
| 970,777 | 9/1910 | Ackerman | 4/578.1 |
| 2,333,734 | 11/1943 | Nieltopp | 248/240.3 X |
| 2,497,412 | 2/1950 | Larin | 297/14 |
| 2,965,153 | 12/1960 | Purcell | 4/578.1 X |
| 3,317,928 | 5/1067 | Root | 4/578.1 |
| 3,579,668 | 5/1971 | Aronovitz | 4/578.1 |
| 4,009,903 | 3/1977 | Manspeaker | 297/14 |
| 4,087,127 | 5/1978 | Lott | 4/578.1 |
| 4,400,835 | 8/1983 | Richter | 4/578.1 |
| 4,602,394 | 7/1986 | Allen et al. | 4/572 X |

*Primary Examiner*—Charles E. Phillips

*Attorney, Agent, or Firm*—John A. Beehner

[57] ABSTRACT

A tub and shower seat adapted for mounting on a wall surface in a tube or shower stall includes an upright seat back, a seat member pivotally connected to the seat back for up and down pivotal movement between an upright storage position and a substantially horizontal use position, and seat supports for limiting downward pivotal movement of the seat member to the use position thereof. Seat back mounting brackets provide for pivotal movement of the seat back about a generally horizontal pivot axis adjacent the upper portion thereof so that the seat back and seat member may be pivoted upwardly and outwardly relative to the brackets for cleaning and disinfecting the back surface of the seat back and the wall surface on which it is mounted.

12 Claims, 8 Drawing Sheets

TUB AND SHOWER SEAT

BACKGROUND OF THE INVENTION

The present invention is directed generally to a foldable seat for a bath tub or shower stall, and more particularly to such a seat having a seat member pivotable to an upright storage position and a seat back pivotable away from the wall for cleaning and disinfecting the entire seat and wall surface against which it is mounted.

Whereas bathing is taken for granted as part of the daily routine for many healthy individuals, it can be a difficult, painful and hazardous activity for individuals with arthritis, the elderly and those with back problems or other deformities or orthopedic impairments which make it difficult to bathe one's legs and lower body. One solution for such individuals is to place a chair in the tub or shower stall, but most chairs are not adapted for that environment and would not be sufficiently stable for safe use.

Custom wall mounted seats for tub and shower stalls have previously been proposed, but these have a number of shortcomings which limit their usefulness. Most must be built into the wall itself, thereby necessitating installation in new construction only, or requiring somewhat major reconstruction for installation in an existing tub or shower stall. Those which may be bolted to an existing tub or shower wall do not permit access to the adjoining surfaces of the seat and wall for cleaning, disinfecting and preventing mildew.

Accordingly, a primary object of the present invention is to provide an improved wall mounted tub and shower seat.

Another object is to provide a tub and shower seat adapted to be pivoted away from the wall on which it is mounted for cleaning and disinfecting the area behind the seat.

Another object is to provide a foldable tub and shower seat which may be collapsed to a compact storage position when not in use.

Another object is to provide a foldable tub and shower seat having secure structural support for the seat member in its lowered use position.

Another object is to provide a tub and shower seat which is simple and rugged in construction, economical to manufacture and efficient in operation.

SUMMARY OF THE INVENTION

The present invention is directed to a tub and shower seat which is adapted to be mounted on the wall surface of a tub or shower stall. The seat includes an upright seat back having a lower portion pivotally connected to a seat member for movement of the seat member from a substantially upright storage position to a substantially horizontal use position. Structural support is provided for limiting downward pivotal movement of the seat member to its use position. The seat back is adapted to be pivotally connected at an upper portion thereof to a wall surface so that it can be pivoted upwardly and outwardly away from the wall surface for cleaning and disinfecting the entire seat and wall surface against which it rests. For this purpose, the seat is mounted with two brackets arranged in spaced apart relation and with the brackets having only minimal surface contact with the wall surface on which the seat is mounted.

DESCRIPTION OF A PREFERRED EMBODIMENT

Figure 1:
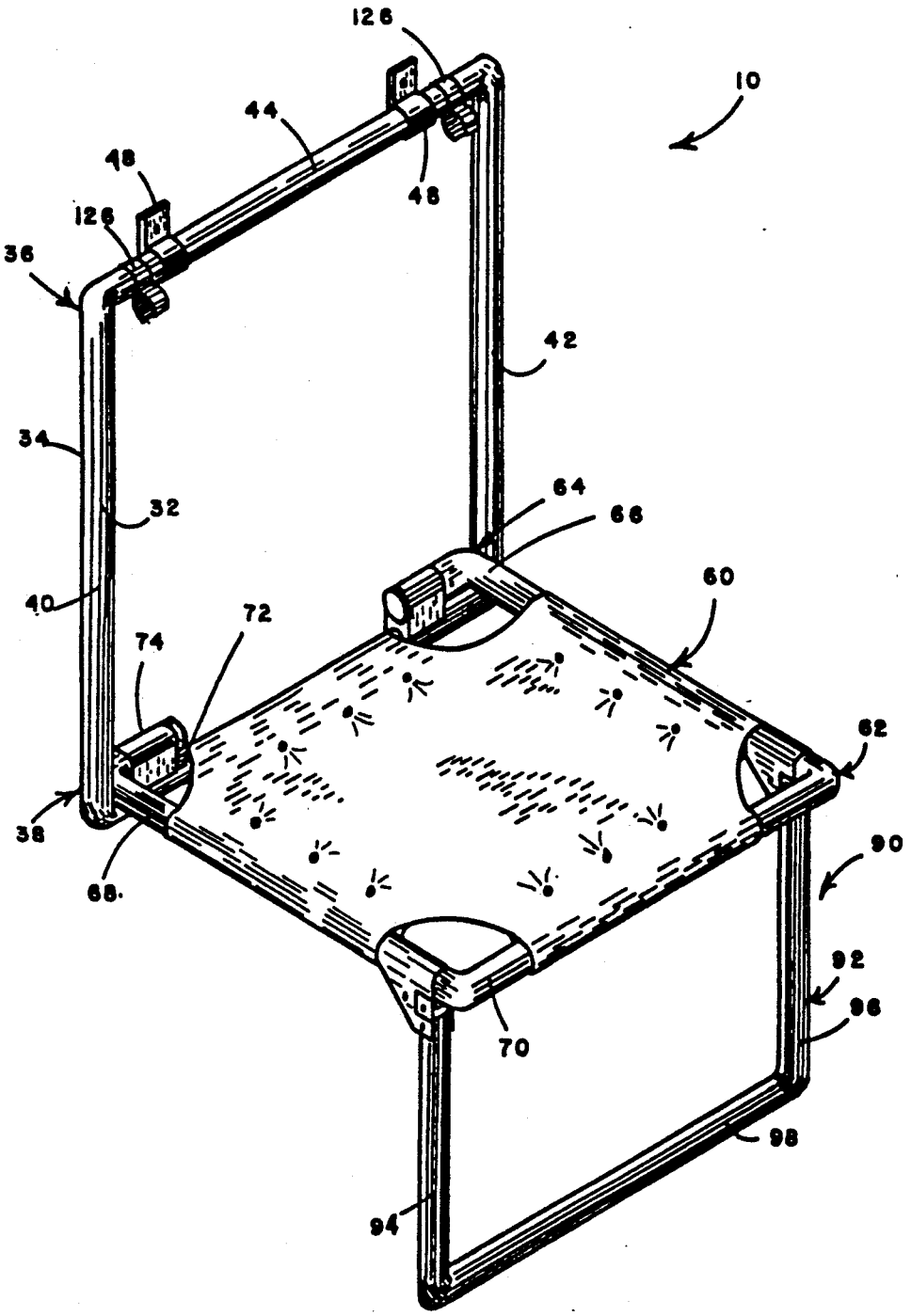
FIG. 1 is a perspective view of the tub and shower seat of the invention.
Figure 2:
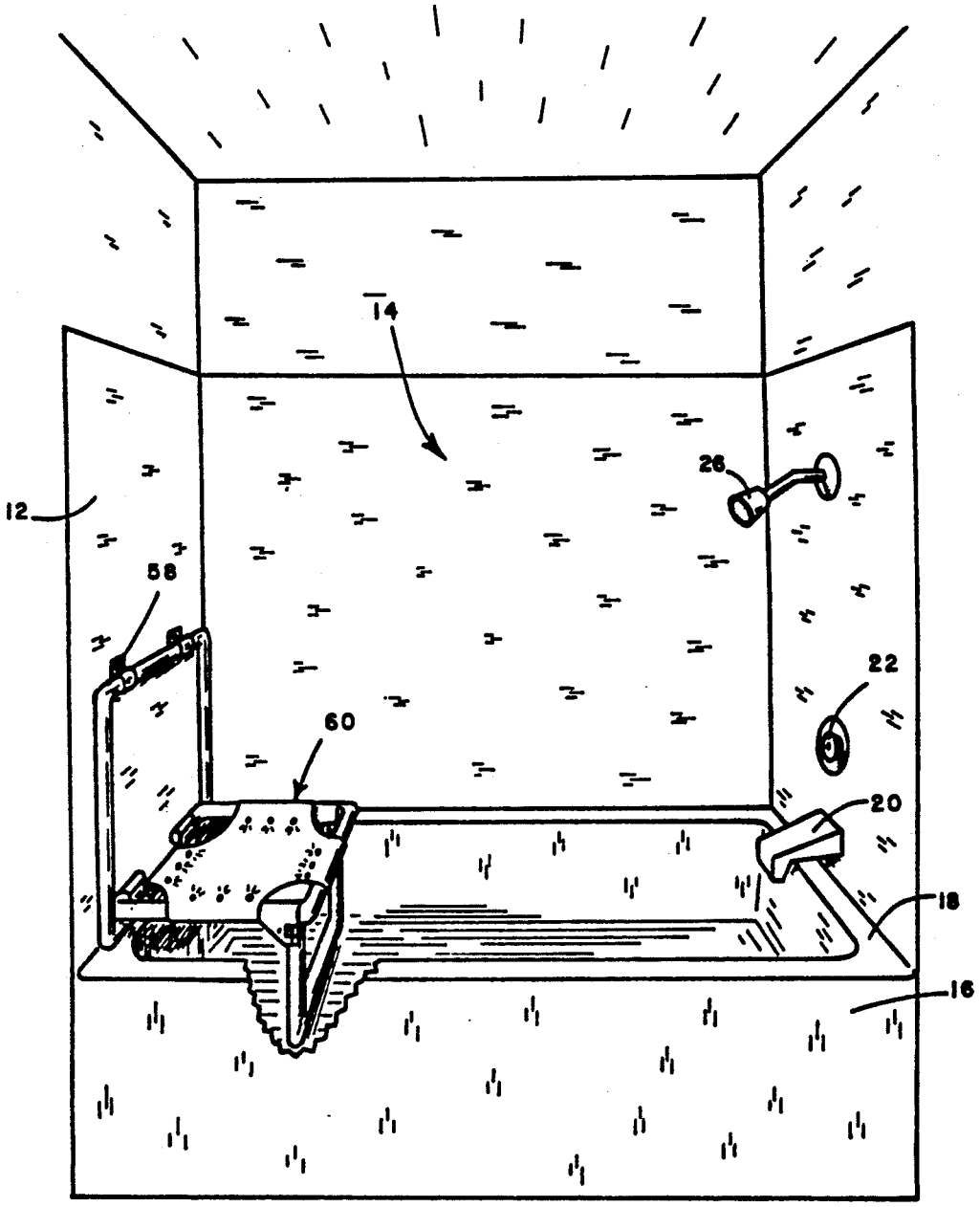
FIG. 2 is a perspective view of the tub and shower seat of the invention installed in a tub and shower stall with a portion of the tub broken away for clarity.

The tub and shower seat 10 of the present invention is illustrated in FIG. 1 and is further illustrated in FIG. 2 installed onto an upright wall surface 12 of a tub and shower stall 14. Stall 14 includes bathtub 16 having a peripheral top surface 18, faucet 20, hot and cold water controls 22 and 24 and shower head 26.

The tub and shower seat 10 of the invention includes an upright seat back 30 having front and back surfaces 32 and 34 and upper and lower portions 36 and 38. Seat back 30 is preferably a generally rectangle shaped continuous peripheral frame of round section tubing including side bars 40 and 42 and top and bottom crossbars 44 and 46.

Figure 3:
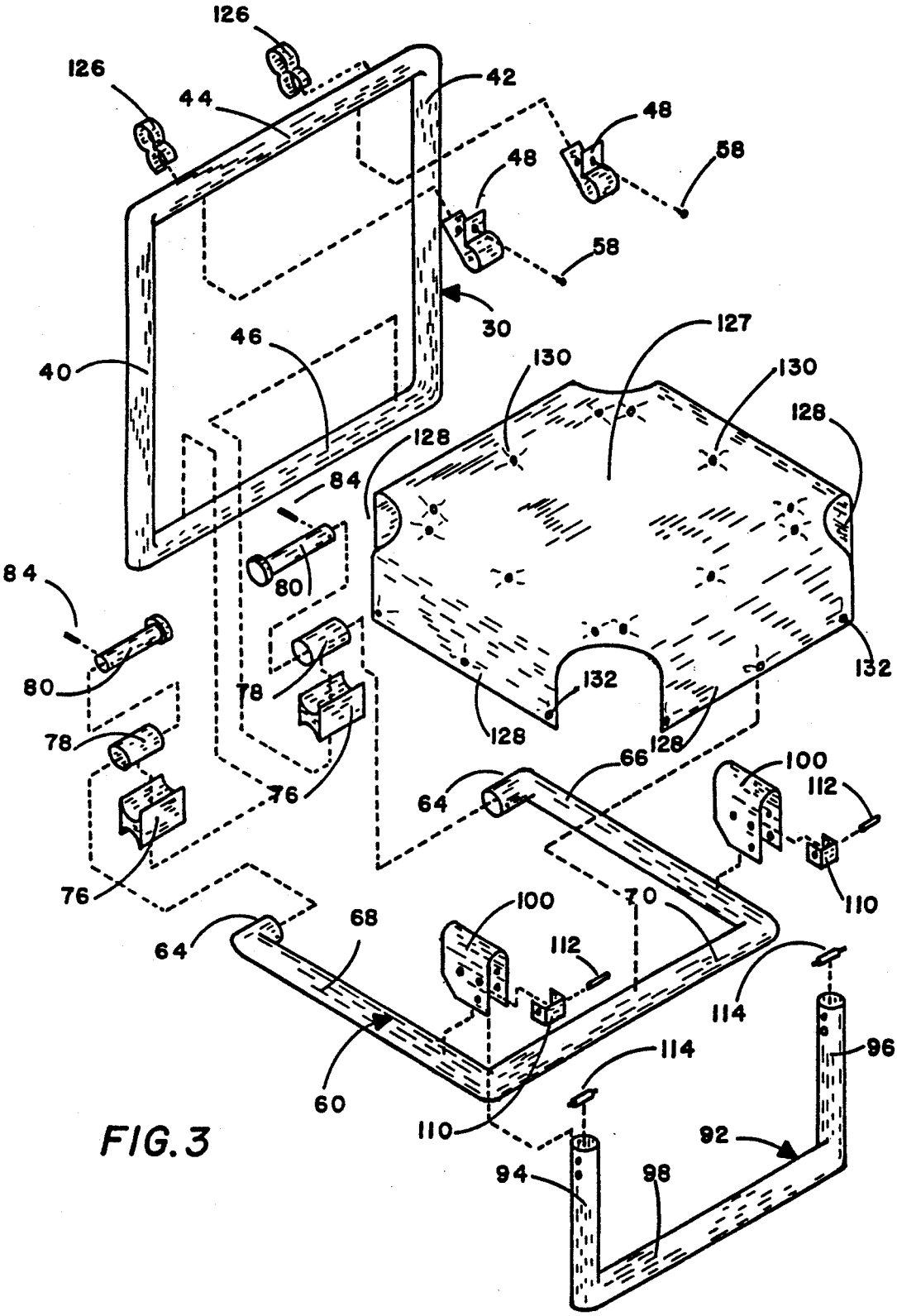
FIG. 3 is an exploded perspective view of the tub and shower seat of the invention.
Figure 10:
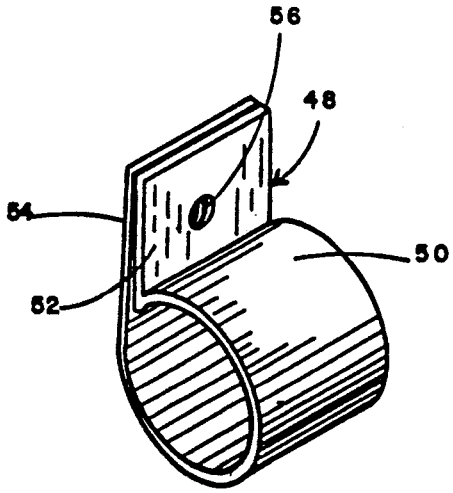
FIG. 10 is an enlarged perspective view of the mounting bracket for the seat back.
Figure 11:
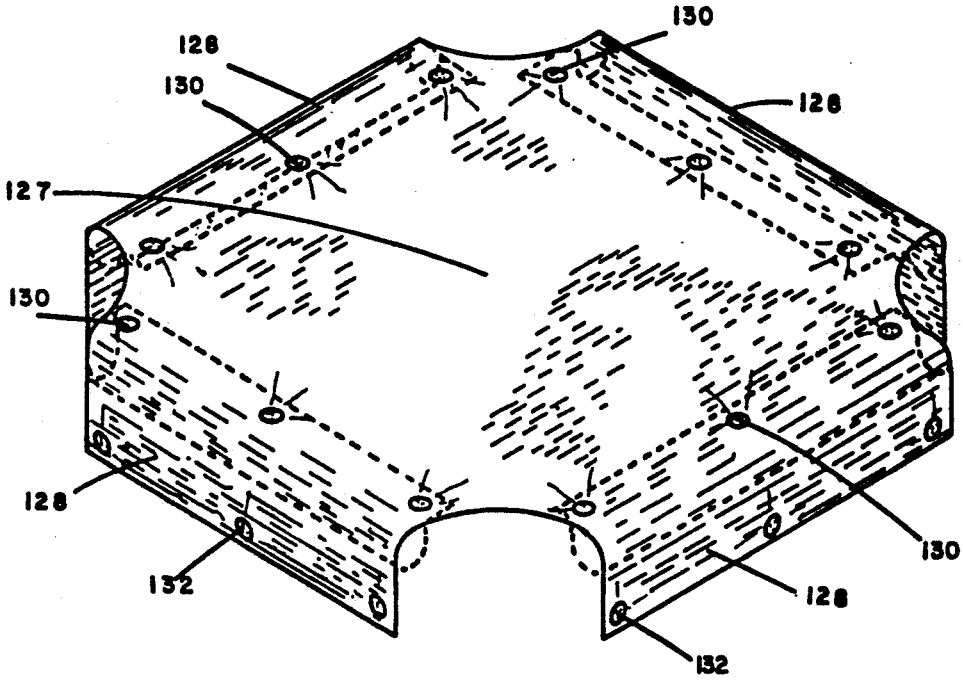
FIG. 11 is a perspective view of the seat cover for the seat member with dotted lines indicating the fastened positions of the flaps thereof.

Seat back 30 is mounted to wall surface 12 by a pair of simple mounting brackets 48 as shown in FIGS. 1, 3, and 10. Each bracket may be formed from a strip of the same material that the tubing of the seat back is made of. The bracket includes a generally circular collar portion 50, for pivotally receiving the top crossbar 44 of seat back 30, and a pair of upright overlying flanges 52 and 54 having aligned holes 56 for securement to wall surface 12 by a screw 58 or any other suitable fastening means. Due to the weight to be supported on the seat, the brackets 48 should be slidably adjusted along top crossbar 44 to positions in alignment with studs behind wall surface 12 for securement of screws 58 through the wall surface and into the studs. Appropriate anchors may be used for securely supporting the brackets on other types of wall surfaces such as concrete block, cement and the like.

The brackets 48 are designed to minimize surface contact between the brackets and the wall surface on which the seat is to be mounted to maximize access to the wall surface for cleaning and disinfecting and to minimize the area of covered or engaged surfaces where mildew might form and collect. Specifically, the vertical height and transverse width of each bracket 48 as seen in FIGS. 3 and 10 are each substantially less than the shorter of the height and width of the upright seat back 30 in its upright position of FIGS. 1 and 2. Alternatively, the area of surface contact between the brackets 48 and wall surface is substantially less than the area calculated by multiplying cross-sectional dimension of the seat back top crossbar 44 times the distance between said brackets measured from the interior edge of each bracket. These are simply objective measurements of a rather subjective feature, namely minimum coverage of the wall on which the seat is mounted.

Figure 4:
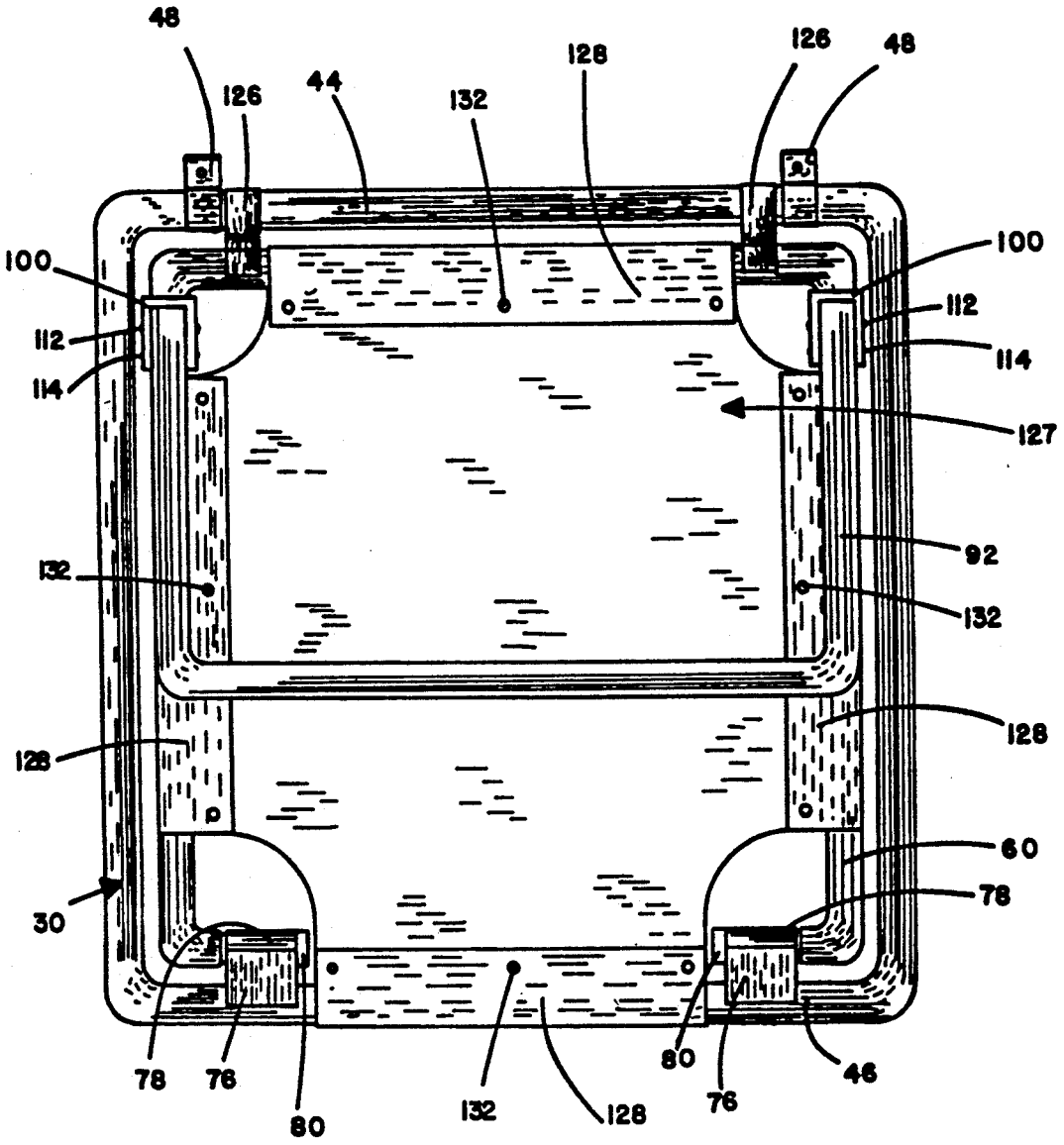
FIG. 4 is a front elevational view of the seat in the collapsed upright storage position.

A seat member 60 is pivotally connected to seat back 30 for up and down pivotal movement between the upright storage position of FIG. 4 and a lowered generally horizontal use position of FIG. 1. The seat member 60 has front and rear portions 62 and 64 and is constructed as a generally U-shaped tubular frame including side bars 66 and 68, a front crossbar 70 and a pair of inwardly directed rear stubs 72, which terminate in spaced apart relation, as shown. The side bars, front crossbar and rear stubs are preferably formed as a single continuous length of tubing material.

Figure 6:
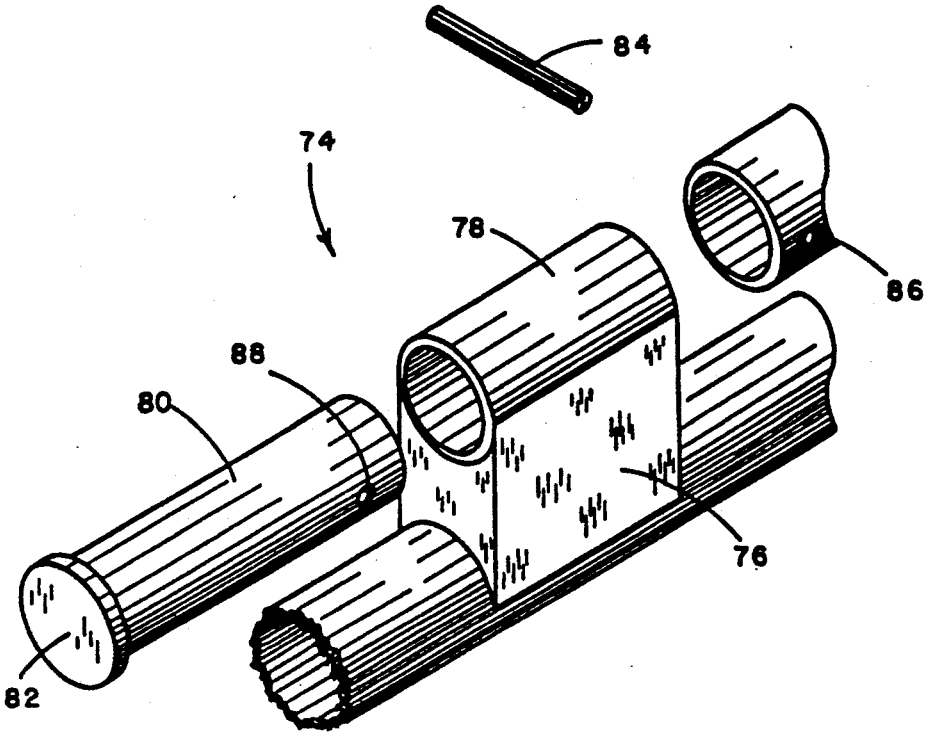
FIG. 6 is a partial perspective view of the connection between the seat back and seat member frames.
Figure 5:
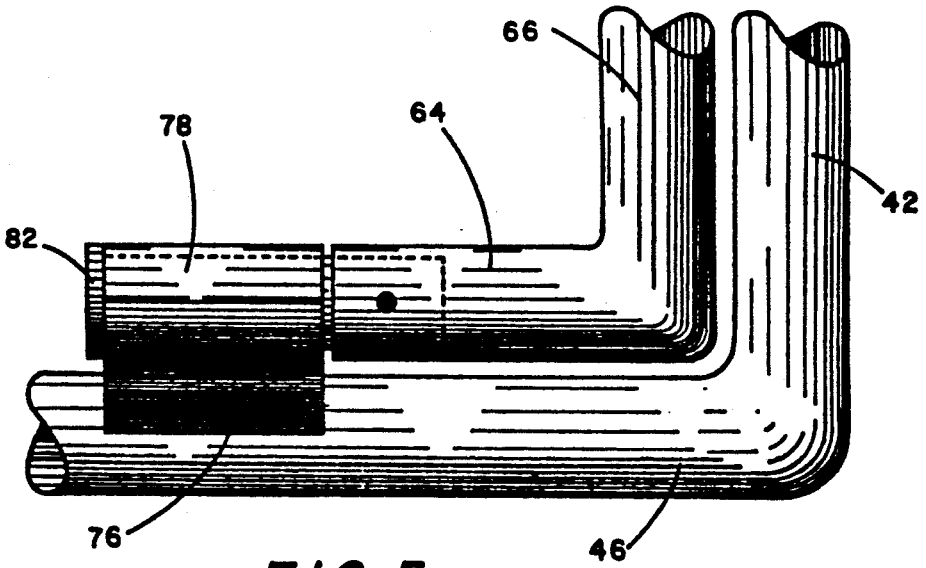
FIG. 5 is an enlarged partial front view of the connection between the seat back and seat member frames.

To pivotally connect the rear portion 64 of seat member 60 to the lower portion 38 of seat back 30, a pair of hinge assemblies 74 are provided as illustrated in FIGS. 3, 5, and 6. Each hinge assembly includes a saddle bracket 76, which is welded, adhered, or otherwise rigidly secured to bottom crossbar 46 of seat back 30. Each saddle bracket 76 includes a tubular collar 78 secured thereto, or formed thereon for telescopically receiving a bushing pin 80. Pin 80 has a head 82 on one end which abuts against the end of the collar to prevent passage of the head 82 through the collar. Bushing pin 80 is sufficiently longer than collar 78 for insertion into an aligned rear stub 72 of seat member 60 for securement thereto by a rivet, bolt or other such securement pin 84 through aligned holes 86 and 88 through the stub 72. The bushing pin 80 is connected to rear stub 72 for pivotal movement in unison relative to the stationary hinge collar 78.

To support the seat in its lowered generally horizontal use position illustrated in FIG. 1, a seat support 90 may be provided, preferably in the form of a U-shaped leg structure 92, including a pair of upright legs 94 and 96, connected together by cross member 98. The upper ends of legs 94 and 96 are pivotally connected to the front portion 62 of seat member 60 for up and down pivotal movement of the leg structure 92 between a use position substantially perpendicular to seat member 60 as shown in FIG. 1 and a storage position substantially parallel to the seat member as shown in FIG. 4.

Figure 8:
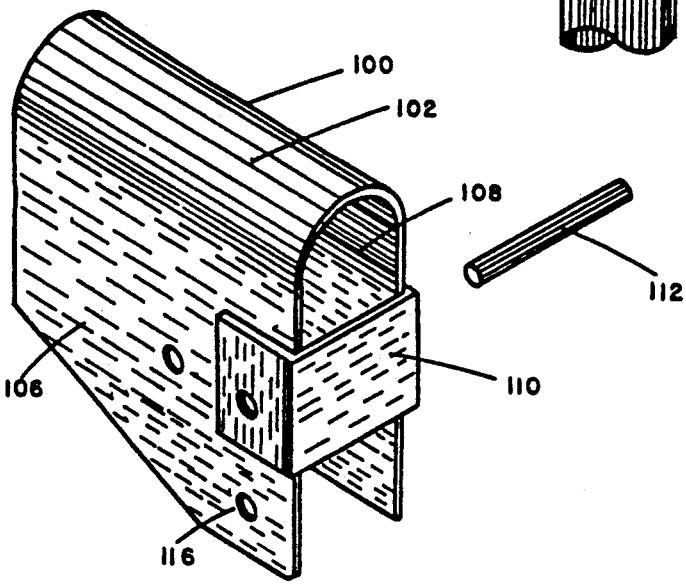
FIG. 8 is a partial perspective view of the bracket for pivotally connecting the legs to the seat member.
Figure 8:
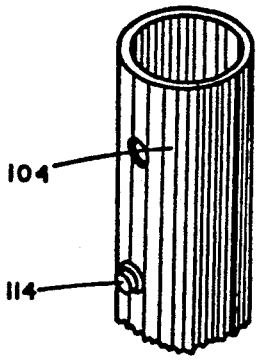

Whereas the seat member 60 and seat back 30 preferably are formed as inter-fitting tubular frames adapted to fit one within the other in the storage position of the seat member 60, as shown in FIG. 4, the leg structure 92 preferably overlays the side bars 66 and 68 of seat member 60 for connection thereto by catch brackets 100. Each catch bracket 100 includes a saddle-shaped shroud draped over the seat member side bars 66 or 68 adjacent the front end thereof and preferably secured thereto by welding, adhesives, or the like. The upper end of each leg 94 has a pair of transversely aligned holes 104 adapted for alignment with a pair of transversely aligned holes through the opposite side plates 106 and 108 of catch bracket 100, and another pair of transversely aligned holes through opposite legs of a generally U-shaped retention bracket 110, as shown in FIG. 8 for receipt of a pivot pin 112 therethrough. Pin 112 may be a rivet, bolt, or any other suitable pivotal connector.

Figure 7:
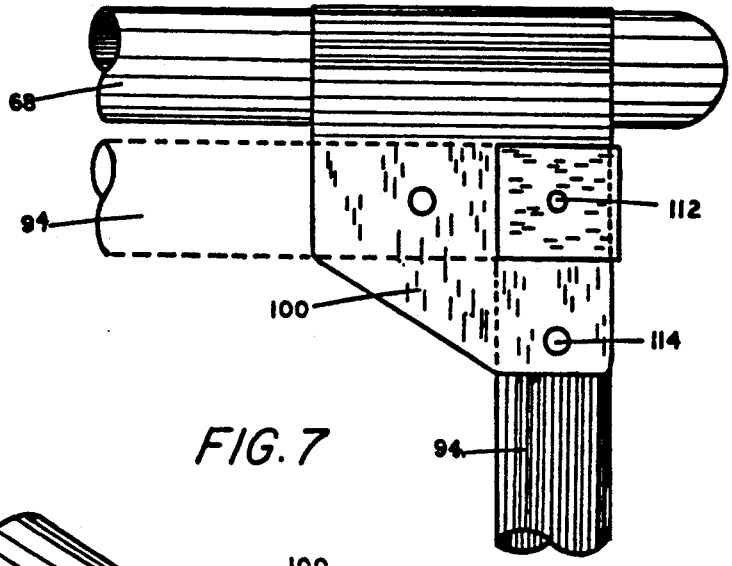
FIG. 7 is a partial side elevational view of the pivotal connection of the leg structure to the seat member.

To releasibly lock the leg structure 92 in its perpendicular use position, as indicated in solid lines in FIG. 7, each leg 94 and 96 is provided with an interiorly facing depressible spring button 114, which is adapted to be snap fit into hole 116 through side plate 106 of catch bracket 100. The insertion of spring button 114 into hole 116 effectively locks the leg structure against pivotal movement relative to seat member 60. When it is desired to collapse the seat member to its storage position, the operator need only depress the spring buttons 114 to enable pivotal movement of the leg structure 92 by gravity upon raising of the seat member 60. The leg structure 92 pivots to its storage position as indicated in dotted lines in FIG. 7 in parallel relation to the seat member 60.

An additional hole 117 may be provided in the side plates of catch brackets 100 for securing the leg structure 92 in its parallel storage position, but that is not necessary since the leg structure is biassed by gravity to its parallel storage position when the seat member is raised to its upright storage position of FIG. 2.

Figure 9:
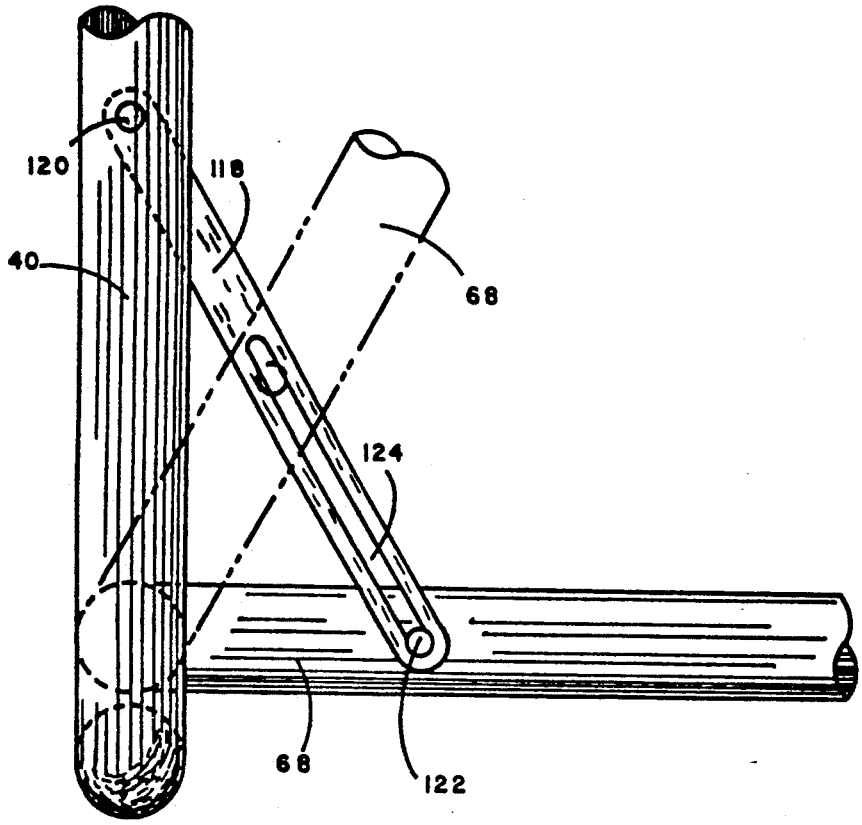
FIG. 9 is a side elevational view of an alternate brace for supporting the seat member in its generally horizontal use position.

As an alternative to the leg structure 92, the seat member 60 may be supported in its use position by a pair of braces 118, each brace being connected between one side bar of seat back 30 and the adjacent side bar of seat number 60, as shown in FIG. 9. The brace 118 of FIG. 9 is a rigid elongated strap pivotally connected at its upper end to seat back 30 by a pivot pin 120, and connected at its lower end to seat member 60 by a pin and slot connection, including pivot pin 122 extended through aligned holes through the respective seat member side bar 66 or 68 and an elongated slot 124 in brace 118. Accordingly, the pin 122 slides upwardly within slot 124 upon collapsing movement of the seat portion to its upright storage position. In the alternative, brace 118 could be hinged at its center with opposite ends pivotally connected to the seat back 30 and seat member 60. Such a brace would need no pin and slot connection since its opposite ends would simply collapse toward one another upon pivotal movement of the seat member to its storage position.

A pair of snap brackets 126 are snap fit onto top crossbar 44 of seat back 30 for releasably engaging the front crossbar 70 of seat member 60 when the seat member is pivoted up into its storage position. The crossbar 70 is snap fit received within the open end of each bracket 126 and then rotates the brackets 126 on top crossbar 44 to accommodate movement of the seat member crossbar 70 to a position directly below seat back crossbar 44. The seat member is readily released by simply pulling it from the brackets 126.

A removable seat cover 127 for seat member 60 is illustrated in FIGS. 1, 2, 3, and 11. In the illustrated embodiment, seat cover 127 is a somewhat cross-shaped piece of material such as naugahyde, vinyl or the like, with the four flaps 128 thereof being foldable around the side bars 66 and 68 and crossbar 70 of seat member 60 and around the bottom crossbar 46 of seat back 40 for a snap fit connection to the underside of the seat cover 126 as illustrated in the dotted line positions in FIG. 11. A series of co-acting snap fasteners 130 and 132 or other suitable fasteners, such as zippers and velcro, are provided on the seat cover for securing the flaps around the associated frame members for supporting a person seated on the seat member 60.

A similar fabric covering may be removably mounted on seat back 30 to provide additional comfort and back support for an individual seated on the seat 10. Whereas the seat cover and seat back cover could be formed of woven nylon straps like those used on lawn furniture, a removable solid sheet material is preferred so that it may be removed for cleaning and for preventing the formation of mildew in the areas of contact between the cover and seat frame.

The seat back 30, seat member 60 and leg structure 92 are preferably formed of round section stainless steel tubing since it will not oxidize like aluminum and may be cleaned and sterilized. This will be important for use of invention in hospitals, nursing homes and even hotels. In this regard, the pivotal connection of the seat back 30 to wall surface 12 clearly facilitates cleaning the seat of the invention and the adjacent wall surface by enabling the seat to be swung out away from the wall surface for ready access to the wall and back surface 34 of the seat back 30.

Whereas the tube and shower seat of the invention has been shown and described in connection with the preferred embodiments thereof, it is understood that many modifications, substitutions and additions may be made which are within the intended broad scope of the appended claims. For example, whereas the seat back and seat member are illustrated as the lightweight tubular frames having a flexible cover stretched thereacross, each could be formed as a contoured plate and hingedly connected to one another by any suitable means. The folding legs need not be integrally formed as part of a single U-shaped structure, but that is preferred both for simplicity and structural integrity. Whereas stainless steel is the preferred material for the frame members of the invention, aluminum, steel, plastic, or other suitable materials could be substituted if desired.

Thus, there has been shown and described an improved tub and shower seat which accomplishes at least all of the stated objects.

I claim:

1. A tub and shower seat for mounting on a wall surface in a tube or shower stall, said seat comprising an upright seat back having front and back surfaces, a top cross bar and a bottom cross bar, mounting means for pivotably mounting said seat back on a wall surface about said top cross bar whereby said seat may be pivoted away from said wall for cleaning, a seat member having front and rear portions, first hinge means for pivotally connecting the rear portion of said seat member about a first axis to said bottom cross bar of said seat back for up and down pivotal movement of said seat member with respect to said seat back from a substantially upright storage position to a substantially horizontal use position, seat support means for limiting downward pivotal movement of said seat member to the use position thereof, said mounting means providing a pivotal movement of said seat back about a second axis parallel to said first axis and adjacent said top cross bar of said seat back whereby said back surface and seat member may be pivoted upwardly and outwardly relative to said mounting means away from said wall surface for cleaning and disinfecting the back surface of said seat back and a portion of said wall surface over which said seat back would extend in said use position, said mounting means comprising two brackets generally slideably encircling said upper cross bar in spaced apart relation along said bar such that said brackets are positionable with respect to each other and said bar in a manner so as to be alignable with studs in said wall for attachment thereto and being of such size and shape that the vertical height and transverse width of each bracket are each substantially less than the shorter of the height and width of said upright seat back thereby to minimize the area of surface contact between said brackets and wall surface.

2. The tub and shower seat of claim 1 wherein said seat support means comprises leg means pivotally connected to the forward portion of said seat member for movement between a use position substantially perpendicular to said seat member and a storage position substantially parallel to said seat member.

3. The tub and shower seat of claim 1 wherein said seat back and seat member comprise inter-fitting tubular frames adapted to fit one within the other in the storage position of said seat member.

4. The tub and shower seat of claim 3 wherein the area of surface contact between said brackets and said wall surface is substantially less than the area calculated by multiplying the cross-sectional width of the seat back tubular frame times the transverse spacing between said brackets.

5. The tub and shower seat of claim 3 wherein said upright seat back comprises a continuous peripheral frame.

6. The tub and shower seat of claim 5 wherein said seat back frame is generally rectangular.

7. The tub and shower seat of claim 6 wherein said tubular frames are generally circular in cross section.

8. The tub and shower seat of claim 1 wherein said seat support means comprises brace means pivotally connected to and extending between said seat back and seat member.

9. The tub and shower seat of claim s wherein said brace means comprises a pin and slot connection to at least one of said seat back and seat member to accommodate pivotal movement of the seat member between the storage and use positions thereof.

10. The tub and shower seat of claim s wherein opposite ends of said brace means may be collapsed toward one another to accommodate pivotal movement of the seat member between the storage and use positions thereof.

11. In combination, a tube or shower stall including an upright wall surface and a tube and shower seat, comprising a tub or shower stall including one or more upright wall surfaces wherein said upright wall surfaces consist of front, rear, and side walls of said tube or shower stall, an upright seat back having front and back surfaces, a top cross bar and a bottom cross bar, mounting means for pivotably mounting said seat back on said rear wall surface about said top cross bar whereby said may be pivoted away from said rear wall for cleaning, a seat member having front and rear portions, first hinge means for pivotally connecting the rear portion of said seat member about a first axis to said bottom cross bar of said seat back for up and down pivotal movement of said seat member with respect to said seat back from a substantially upright storage position to a substantially horizontal use position, seat support means for limiting downward pivotal movement of said seat member to the use position thereof, said mounting means providing for pivotal movement of said seat back about a second axis parallel to said first axis and adjacent said top cross bar of said seat back whereby said back surface and seat member maybe pivoted upwardly and outwardly relative to said mounting means away from said rear wall surface for cleaning and disinfecting the back surface of said seat back and a portion of said rear wall surface over which said seat back would extend in said use position, said mounting means comprising two brackets generally slidable encircling said upper cross bar in spaced apart relation along said bar such that said brackets are positionable with respect to each other and said bar in a manner so as to be alignable with studs in said rear wall for attachment thereto and being of such size and shape that the vertical height and transverse width of each bracket are each substantially less than the shorter of the height and width of said upright seat back thereby to minimize the area of surface contact between said brackets and rear wall surface.

12. The combination of claim 11 wherein the area of surface contact between said brackets and said wall surface is substantially less than the area calculated by multiplying the cross-sectional width of the seat back tubular frame times the transverse spacing between said brackets.

* * * * *